US005669503A

United States Patent [19]

Robin

[11] Patent Number: 5,669,503

[45] Date of Patent: Sep. 23, 1997

[54] MEDICATION DOSE CONTROL SYSTEM

[76] Inventor: Brian Abe Robin, 3626 Kings Hwy. 2D, Brooklyn, N.Y. 11234

[21] Appl. No.: 630,941

[22] Filed: Apr. 5, 1996

[51] Int. Cl.[6] ..... B65D 21/00

[52] U.S. Cl. ..... 206/528; 206/534; 206/536; 220/4.27

[58] Field of Search ..... 206/528, 534, 206/535, 536, 538, 540, 503, 504; 220/23.4, 23.83, 4.26, 4.27, 4.21

[56] References Cited

U.S. PATENT DOCUMENTS 4,756,407 7/1988 Larsen ..... 206/528 X
5,181,189 1/1993 Hafner ..... 206/534 X

*Primary Examiner*—Jacob K. Ackun

[57] ABSTRACT

A medication dose control system comprising: a housing including a main unit including a essentially hollow interior and a central section, a front wall and a back wall, the main unit including a central axle extending from the front wall to the back wall, a rotatable handle being positioned in the front wall and operatively coupled to the axle to permit rotation by a user, the central section including a dispensing cylinder positioned around the central axle and including a plurality of separate dispensing chambers, a lid being coupled to the central section of each unit, each dispensing chamber including a rack with a plurality of compartments separated by notches; and a medication pouch having an upper region with two side brackets and a lower region, the upper region including a label tab, each medication pouch being positionable in a compartment of a dispensing chamber, the medication to be taken by a user at a specific time of the day being positioned in the lower section of the pouch and accessed by a user when desired.

5 Claims, 3 Drawing Sheets

22
38
52
54
25
16
6
56
4
58
58
6
4
22

MEDICATION DOSE CONTROL SYSTEM

BACKGROUND OF THE INVENTION

1. Field of the Invention

The present invention relates to a medication dose control system and more particularly pertains to dispensing fixed quantities of medication at predetermined intervals.

2. Description of the Prior Art

The use of pill storage devices is known in the prior art. More specifically, pill storage devices heretofore devised and utilized for the purpose of storing and dispensing pills are known to consist basically of familiar, expected, and obvious structural configurations, notwithstanding the myriad of designs encompassed by the crowded prior art which has been developed for the fulfillment of countless objectives and requirements.

By way of example, the prior art discloses in U.S. Pat. No. 5,261,702 to Mayfield a daily medication management system.

U.S. Pat. No. 5,322,166 to Crowther discloses a pill storage and dispensing container.

U.S. Pat. No. Des. 298,803 to Ebling discloses a compartmented pill container.

U.S. Pat. No. 4,889,237 to Brandon discloses a pill container calendar.

U.S. Pat. No. 5,226,539 to Cheng discloses a pill container.

Lastly, U.S. Pat. No. 4,815,767 to Lambert discloses a method and system for documenting and controlling the taking of medication.

In this respect, the medication dose control system according to the present invention substantially departs from the conventional concepts and designs of the prior art, and in doing so provides an apparatus primarily developed for the purpose of dispensing fixed quantities of medication at predetermined intervals.

Therefore, it can be appreciated that there exists a continuing need for a new and improved medication dose control system which can be used for dispensing fixed quantities of medication at predetermined intervals. In this regard, the present invention substantially fulfills this need.

SUMMARY OF THE INVENTION

In view of the foregoing disadvantages inherent in the known types of pill storage devices now present in the prior art, the present invention provides an improved medication dose control system. As such, the general purpose of the present invention, which will be described subsequently in greater detail, is to provide a new and improved medication dose control system and method which has all the advantages of the prior art and none of the disadvantages.

To attain this, the present invention essentially comprises a medication dose control system comprising: a new and improved medication dose control system comprising, in combination: a housing including a main unit and an attachable unit, each unit being formed in an elongated generally cylindrical configuration with an upper surface, a lower surface and an essentially hollow interior, each unit including two outer sections and a central section, each outer section including a pivotally coupled rounded storage door affixed therearound, a user storing various objects within the outer sections, the main unit having a front wall and a coupling wall, the front wall including a liquid crystal display clock alarm, the clock alarm including means to be set so that the alarm rings at a predetermined time, a speaker being positioned in the front wall and operatively coupled to the clock alarm, the main unit including a central axle extending from the approximate center point of the front wall to the approximate center point of the coupling wall, a rotatable handle being positioned in the front wall and operatively coupled to the axle to permit rotation of the axle by a user, the coupling wall of the main unit including four arrow shaped projections extending therefrom, the coupling wall further including an extension member operatively coupled to the axle of the main unit; the attachable unit having a coupling wall and a rear wall, the coupling wall including four arrow shaped recesses and an extension member aperture, in an operative orientation the arrow shaped projections and extension member being coupled within the arrow shaped projections and extension member aperture of the attachable unit, respectively; the central section of each unit including a dispensing cylinder positioned around the central axle, the dispensing cylinder including eight separate dispensing chambers, a generally rectangular shaped lid being pivotally coupled to the upper surface of the central section of each unit, each dispensing chamber including a rack with twelve compartments separated by notches, the notches being positioned adjacent to each side wall of each rack; a medication pouch having a rigid upper region and a soft lower region, the lower region formed in an elongated generally semispherical configuration with a hollow interior, the upper region formed in a generally rectangular configuration with a central aperture and being affixed to the lower region, the upper region including two semirigid side brackets, each side bracket having a central outer depression positioned therein, the upper region including a label tab and a lid including a thumb lift affixed thereto, each medication pouch being positionable in a compartment of a dispensing chamber, the medication to be taken by a user at a specific time of the day being positioned in the lower section of the pouch and accessed by a user with the alarm being sounded.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved medication dose control system which has all of the advantages of the prior art pill storage devices and none of the disadvantages.

It is another object of the present invention to provide a new and improved medication dose control system which may be easily and efficiently manufactured and marketed.

It is further object of the present invention to provide a new and improved medication dose control system which is of durable and reliable constructions.

An even further object of the present invention is to provide a new and improved medication dose control system which is susceptible of a low cost of manufacture with regard to both materials and labor, and which accordingly is then susceptible of low prices of sale to the consuming public, thereby making such medication dose control system economically available to the buying public.

Still yet another object of the present invention is to provide a new and improved medication dose control system which provides in the apparatuses and methods of the prior art some of the advantages thereof, while simultaneously overcoming some of the disadvantages normally associated therewith.

Still another object of the present invention is dispensing fixed quantities of medication at predetermined intervals.

Lastly, it is an object of the present invention to provide a new and improved medication dose control system comprising: a housing including a main unit formed in an cylindrical configuration with an essentially hollow interior, a central section, a front wall and a back wall, the main unit including a central axle extending from the front wall to the back wall, a rotatable handle being positioned in the front wall and operatively coupled to the axle to permit rotation by a user, the central section including a dispensing cylinder positioned around the central axle, the dispensing cylinder including a plurality of separate dispensing chambers, a lid being coupled to the upper surface of the central section of each unit, each dispensing chamber including a rack with a plurality of compartments separated by notches, the notches being positioned adjacent to each side wall of each rack; and a medication pouch having an upper region with two side brackets and a lower region, the upper region including a label tab, each medication pouch being positionable in a compartment of a dispensing chamber, the medication to be taken by a user at a specific time of the day being positioned in the lower section of the pouch and accessed by a user when desired.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
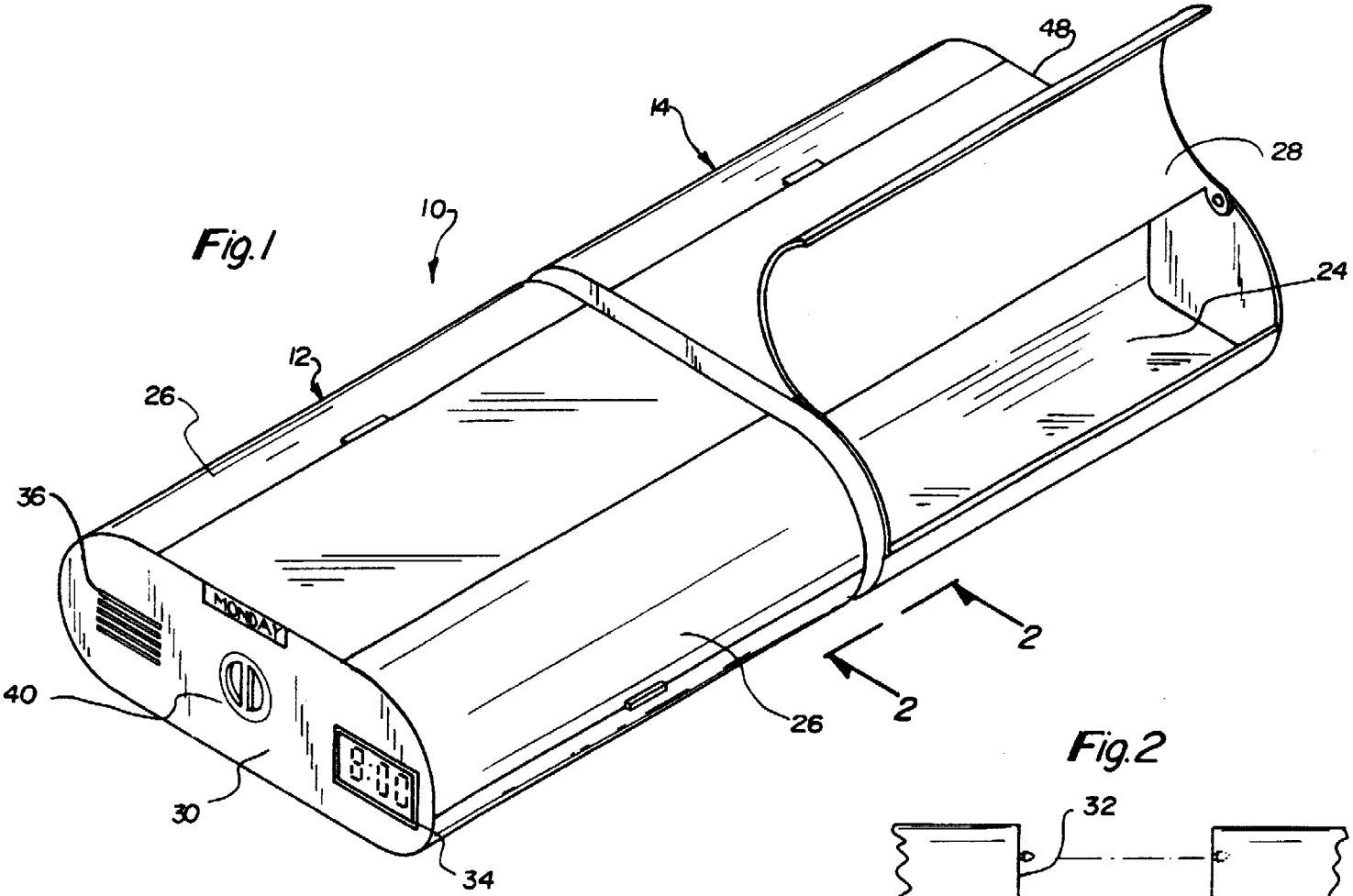
FIG. 1 is a perspective view of the preferred embodiment of the medication dose control system constructed in accordance with the principles of the present invention.

With reference now to the drawings, and in particular to FIG. 1 thereof, the preferred embodiment of the new and improved medication dose control system embodying the principles and concepts of the present invention and generally designated by the reference numeral 10 will be described.

The present invention, the medication dose control system 10 is comprised of a plurality of components. Such components in their broadest context include a main unit 12, an attachable unit 14, a dispensing cylinder 16, and a plurality of pouches 18. Such components are individually configured and correlated with respect to each other so as to attain the desired objective.

More specifically, the housing includes a main unit 12 and an attachable unit 14. Each unit is formed in an elongated generally cylindrical configuration with an upper surface, a lower surface and an essentially hollow interior. Each unit also includes two outer sections 22, 24 and a central section 25. The housing is fabricated of plastic in the preferred embodiment. In alternative embodiments, the housing may be fabricated of aluminum or other lightweight metal. Each outer section includes a pivotally coupled rounded storage door 26, 28 affixed to it adjacent to the central section. The doors pivot upwardly and toward the central section when opened. A user may store various objects, additional medication, a water cup and snacks within the outer sections, if desired. Note FIG. 1.

The main unit has a front wall 30 and a coupling wall 32 at its rear extent. The front wall includes a liquid crystal display clock alarm 34. The clock alarm includes means to set the alarm so that the alarm rings at a predetermined time. Such predetermined time is ordinarily when a user is required to consume medication. A speaker 36 is positioned in the front wall and operatively coupled to the clock alarm. When the alarm goes off at the set time, a buzzing sound is heard from the speaker. Note FIG. 1.

Figure 2:
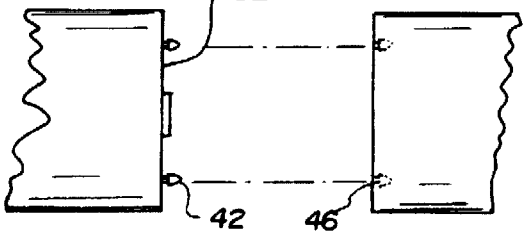
FIG. 2 is a partially broken away perspective view of the two units of the apparatus shown in a separated orientation.
Figures 3, 4:
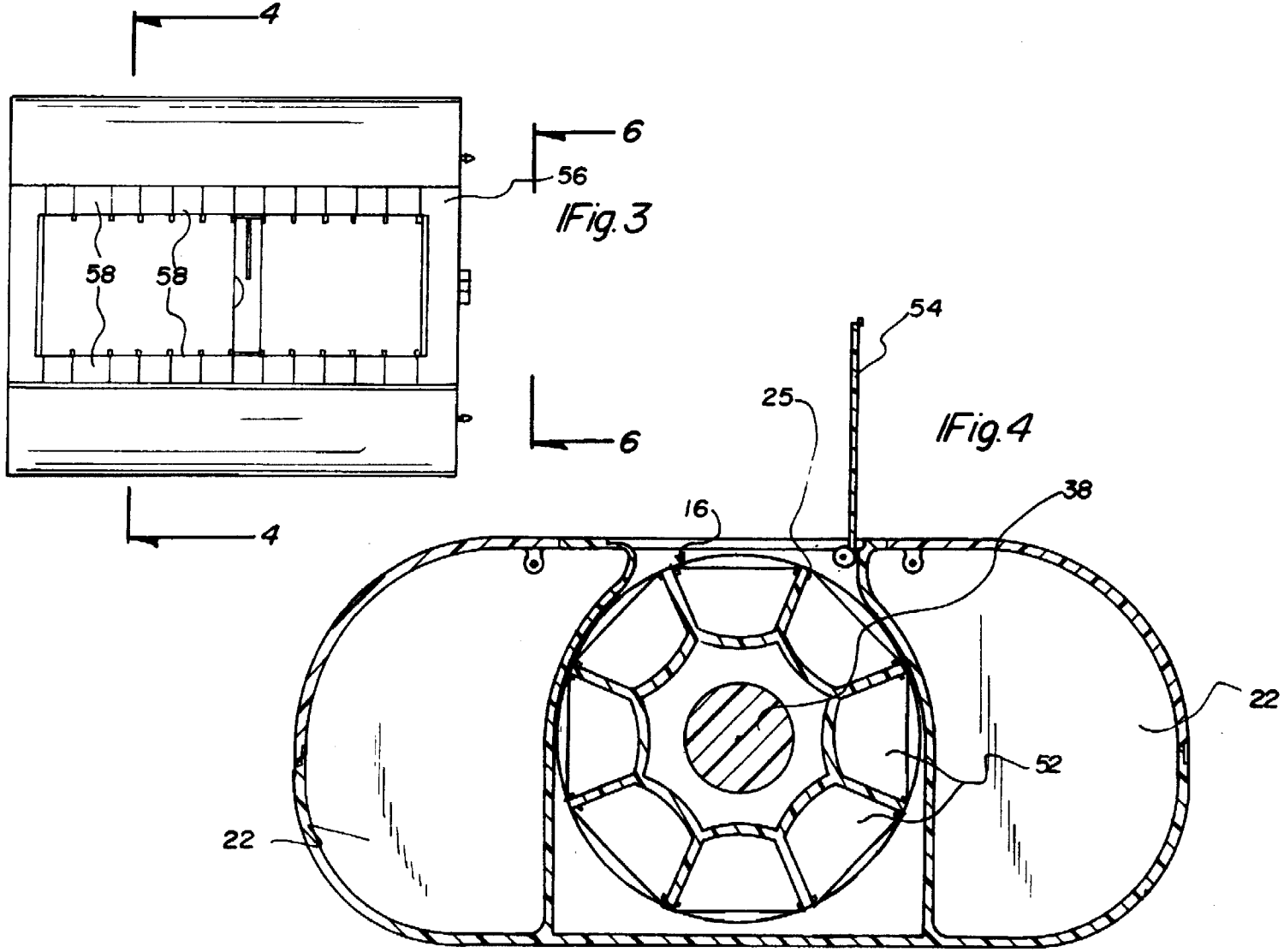
FIG. 3 is a top perspective view of the main unit of the apparatus illustrating the configuration of a rack within a dispensing cylinder.
FIG. 4 is a front cross sectional view of the dispensing cylinder taken along section line 4—4 of FIG. 3.
Figure 6:
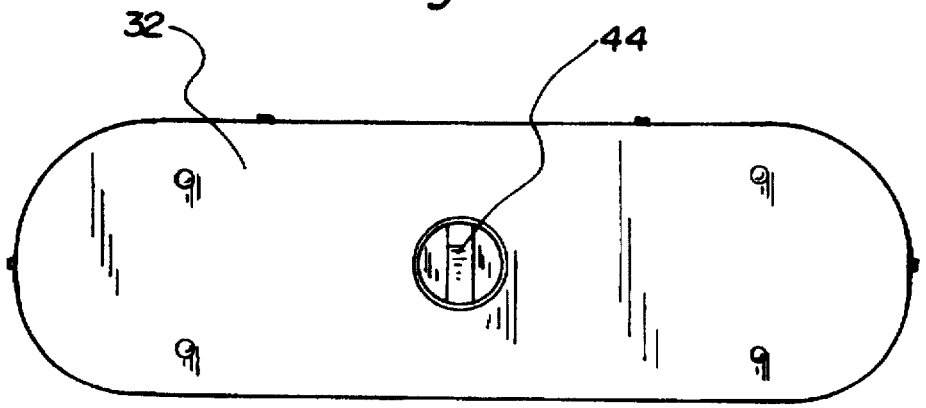
FIG. 6 is an elevational view of the coupling end of the main compartment of the apparatus.

The main unit includes a central axle 38 which extends from the approximate center point of the front wall to the approximate center point of the coupling wall. A rotatable handle 40 is positioned in the front wall and is operatively coupled to the axle to permit rotation of the axle by a user. The central axle is firmly secured within the main unit to preclude rotation unless the handle is rotated by the user. The coupling wall of the main unit includes four arrow shaped projections 42 extending from it. The coupling wall further includes an extension member 44 which is operatively coupled to the axle of the main unit. In an operative orientation, the projections and extension member are coupled to the coupling wall of the attachable unit. Note FIGS. 2, 4, and 6.

The attachable unit has a coupling wall 46 and a rear wall 48. The coupling wall is positioned at the front extent of the unit. The coupling wall includes four arrow shaped recesses 50 and an extension member aperture. In an operative orientation, the arrow shaped projections and extension member are coupled within the arrow shaped projections and extension member aperture of the attachable unit, respectively. The arrow shaped projections of the coupling wall of the main unit precludes inadvertent separation of main unit from the attachable unit. Note FIGS. 2 and 6.

The central section of each unit includes a dispensing cylinder 16 positioned around the central axle. The dispensing cylinder includes eight separate dispensing chambers 52 which extend from the front extent of each unit to the rear extent. When the main and attachable units are coupled together, a user can rotate the dispensing cylinders of both units by turning the handle of the main unit. The dispensing chambers can be used for the same or various types of medicine. Note FIGS. 1 and 4.

The dispensing chamber includes a generally rectangular shaped lid 54 which is pivotally coupled to the upper surface of the central section of each unit. Each dispensing chamber includes a rack 56 with twelve compartments 58 separated by notches. The notches are positioned adjacent to each side wall of each rack. Hour markers are positionable adjacent to each compartment of each rack to correspond to hours in a day. The racks of the dispensing chamber of the main unit include hour markers indicating 1:00 am through 12 noon. The racks of the dispensing chamber of the attachable unit include hour markers indicating 1:00 pm through 12 midnight. A user can utilize the main unit by itself or in tandem with the detachable unit, depending on the time of day needed. Note FIGS. 3 and 4.

Figure 5:
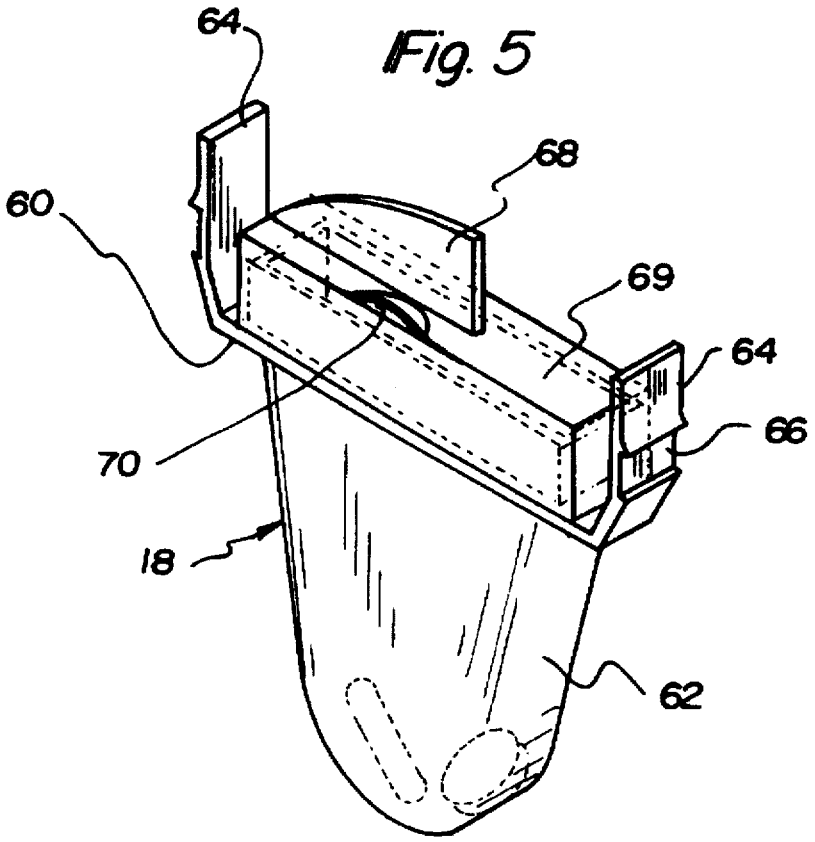
FIG. 5 is a perspective view of a medication pouch of the apparatus.

A medication pouch 18 has an upper region 60 fabricated of rigid plastic. The pouch has a lower region fabricated of soft, transparent plastic. The upper region is formed in a generally rectangular configuration with a central aperture and is affixed to the upper extent of the lower region. The lower region is formed in an elongated generally semispherical configuration with a hollow interior. Medication is placed in the lower region of the pouch in an operative orientation. Note FIG. 5.

The upper region includes two semirigid plastic side brackets 64. The upper extent of the side brackets includes a concave surface to insure a tight fit within the compartments of a dispensing chamber in an operative orientation. Each side bracket has a central outer depression 66 positioned within it. The upper region includes a label tab 68 and a lid 69 including a thumb lift 70 affixed to it. Various labels may be affixed to the thumb tab indicating the type of medication contained within the pouch. The lid allows medication stored in the pouch in an air tight manner. Each medication pouch is positionable in a compartment of a rack of a dispensing chamber. The medication to be taken by a user at a specific time of the day is positioned in the lower section of the pouch and accessed by a user when the alarm is sounded. This is accomplished by lifting the thumb tab of the upper region of the pouch thereby releasing the air tight sealed medication contained within the lower region. Note FIGS. 3–5.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A new and improved medication dose control system comprising, in combination:

a housing including a main unit and an attachable unit, each unit being formed in an elongated generally cylindrical configuration with an upper surface, a lower surface and an essentially hollow interior, each unit including two outer sections and a central section, each outer section including a pivotally coupled rounded storage door affixed therearound, a user storing various objects within the outer sections, the main unit having a front wall and a coupling wall, the front wall including a liquid crystal display clock alarm, the clock alarm including means to be set so that the alarm rings at a predetermined time, a speaker being positioned in the front wall and operatively coupled to the clock alarm, the main unit including a central axle extending from the approximate center point of the front wall to the approximate center point of the coupling wall, a rotatable handle being positioned in the front wall and operatively coupled to the axle to permit rotation of the axle by a user, the coupling wall of the main unit including four arrow shaped projections extending therefrom, the coupling wall further including an extension member operatively coupled to the axle of the main unit;

the attachable unit having a coupling wall and a rear wall, the coupling wall including four arrow shaped recesses and an extension member aperture, in an operative orientation the arrow shaped projections and extension member being coupled within the arrow shaped projections and extension member aperture of the attachable unit, respectively;

the central section of each unit including a dispensing cylinder positioned around the central axle, the dispensing cylinder including eight separate dispensing chambers, a generally rectangular shaped lid being pivotally coupled to the upper surface of the central section of each unit, each dispensing chamber including a rack with twelve compartments separated by notches, the notches being positioned adjacent to each side wall of each rack; and a medication pouch having a rigid upper region and a soft lower region, the lower region formed in an elongated generally semispherical configuration with a hollow interior, the upper region formed in a generally rectangular configuration with a central aperture and being affixed to the lower region, the upper region including two semirigid side brackets, each side bracket having a central outer depression positioned therein, the upper region including a label tab and a lid including a thumb lift affixed thereto, each medication pouch being positionable in a compartment of a dispensing chamber, the medication to be taken by a user at a specific time of the day being positioned in the lower section of the pouch and accessed by a user with the alarm being sounded.

2. A medication dose control system comprising:

a housing including a main unit formed in an cylindrical configuration with an essentially hollow interior, a central section, a front wall and a back wall, the main unit including a central axle extending from the front wall to the back wall, a rotatable handle being positioned in the front wall and operatively coupled to the axle to permit rotation by a user, the central section including a dispensing cylinder positioned around the central axle, the dispensing cylinder including a plurality of separate dispensing chambers, a lid being coupled to the upper surface of the central section of each unit, each dispensing chamber including a rack with a plurality of compartments separated by notches, the notches being positioned adjacent to each side wall of each rack; and a medication pouch having an upper region with two side brackets and a lower region, the upper region including a label tab, each medication pouch being positionable in a compartment of a dispensing chamber, the medication to be taken by a user at a specific time of the day being positioned in the lower section of the pouch and accessed by a user when desired.

3. The medication dose control system as set forth in claim 2 wherein the back wall of the main unit includes four arrow shaped projections and an extension member operatively coupled to the axle, the apparatus further including:

an attachable unit including a central section, an axle, a dispensing cylinder positioned around the axle, the dispensing cylinder including a plurality of dispensing chambers each including a rack and a plurality of pouches positionable within the dispensing chambers, the attachable unit having a coupling wall and a rear wall, the coupling wall including four arrow shaped recesses and an extension member aperture, in an operative orientation the arrow shaped projections and extension member being coupled within the arrow shaped projections and extension member aperture of the attachable unit, respectively.

4. The medication dose control system as set forth in claim 3 wherein each unit includes two outer sections, each outer section including a pivotally coupled rounded storage door affixed therearound, a user storing various objects within the outer sections.

5. The medication dose control system as set forth in claim 2 wherein the front wall of the main unit includes a liquid crystal display clock alarm, the clock alarm including means to be set so that the alarm rings at a predetermined time, a speaker being positioned in the front wall and operatively coupled to the clock alarm.

* * * * *